US009033827B2

(12) United States Patent
Madson et al.

(10) Patent No.: US 9,033,827 B2
(45) Date of Patent: May 19, 2015

(54) GOLF BALL DIMPLE PROFILE

(75) Inventors: Michael R. Madson, Wrentham, MA (US); Nicholas M. Nardacci, Bristol, RI (US); Chris Hixenbaugh, Dartmouth, MA (US)

(73) Assignee: Acushnet Company, Fairhaven, MA (US)

( * ) Notice: Subject to any disclaimer, the term of this patent is extended or adjusted under 35 U.S.C. 154(b) by 495 days.

(21) Appl. No.: 13/341,689

(22) Filed: Dec. 30, 2011

(65) Prior Publication Data

US 2013/0172126 A1 Jul. 4, 2013

(51) Int. Cl.
*A63B 37/12* (2006.01)
*A63B 37/00* (2006.01)

(52) U.S. Cl.
CPC ..... *A63B 37/0012* (2013.01); *A63B 37/0019* (2013.01); *A63B 37/002* (2013.01); *A63B 37/0073* (2013.01); *A63B 37/0074* (2013.01); *A63B 37/0075* (2013.01); *A63B 37/0076* (2013.01)

(58) Field of Classification Search
CPC ..... A63B 37/0012
USPC ..... 473/383–385
See application file for complete search history.

(56) References Cited

U.S. PATENT DOCUMENTS 6,464,601 B2 * 10/2002 Ogg ..... 473/383
8,137,217 B2 * 3/2012 Madson et al. ..... 473/383

* cited by examiner

*Primary Examiner* — Raeann Gorden
(74) *Attorney, Agent, or Firm* — Mandi B. Milbank

(57) ABSTRACT

Golf ball dimples having a cross-sectional profile shape defined by a semi-cubical parabola function are disclosed.

6 Claims, 2 Drawing Sheets

GOLF BALL DIMPLE PROFILE

FIELD OF THE INVENTION

The present invention relates to a golf ball dimple cross-sectional profile defined by a curve that is based on a semi-cubical parabola.

BACKGROUND OF THE INVENTION

Golf ball dimples are known to have a significant effect on the aerodynamic forces acting on the ball during flight. For example, the dimples on a golf ball create a turbulent boundary layer around the ball. The turbulence energizes the boundary layer and helps it stay attached further around the ball to reduce the area of the wake. This greatly increases the pressure behind the ball and substantially reduces the drag. Based on the role that dimples play in reducing drag, golf ball manufacturers continually seek to develop novel dimple patterns, sizes, shapes, volumes, cross-sections, etc., in order to optimize flight performance.

SUMMARY OF THE INVENTION

In a particular embodiment, the present invention is directed to a golf ball having a plurality of recessed dimples on the surface thereof, at least a portion of which have a cross-sectional profile defined by a curve based on a semi-cubical parabola in the form of:

$$y(x) = a\left(\sqrt[3]{x^2} - \sqrt[3]{\left(\frac{d}{2}\right)^2}\right)$$

wherein a is the depth factor, d is the dimple diameter, and wherein $$\frac{-d}{2} \le x \le \frac{d}{2}.$$

BRIEF DESCRIPTION OF DRAWINGS

In the accompanying drawings, which form a part of the specification and are to be read in conjunction therewith, and which are given by way of illustration only, and thus are not meant to limit the present invention.

DETAILED DESCRIPTION

Figure 1:
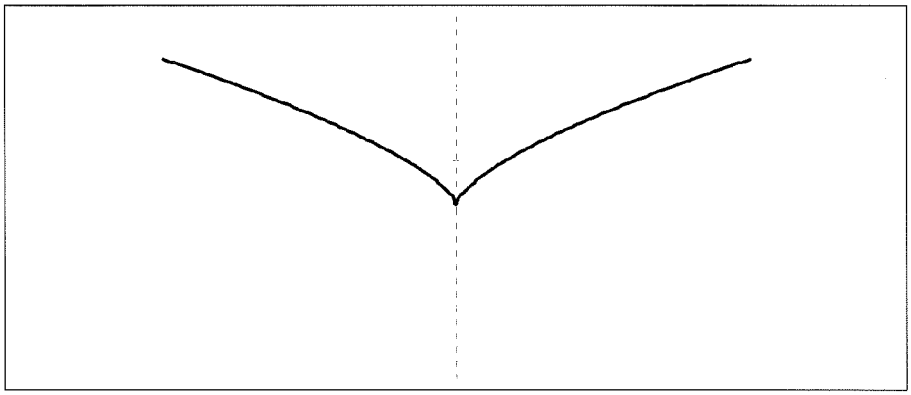
FIG. 1 shows a curve based on a semi-cubical parabola.

Golf balls of the present invention include dimples having a cross-sectional profile defined by a curve based on a semi-cubical parabola. Such a curve is illustrated in FIG. 1 and is defined by the Cartesian equation:

$$y(x)=a\sqrt[3]{x^2},$$

wherein 'a,' referred to herein as the depth factor, is a variable that changes the amplitude of the curve.

In order to properly manipulate the curve for the purpose of dimple design, the following are taken into account:

1) the chord plane of the dimple represents y=0;
2) the axis in the center of the dimple represents x=0; and
3) y is only evaluated within the range of the dimple diameter, d, and:

$$\frac{-d}{2} \le x \le \frac{d}{2}.$$

The curve is then shifted so that it intersects the chord plane at the edges of the dimple. The resulting equation, given below, wherein 'a' is the depth factor and is the dimple diameter, defines the dimple and is continuous and differentiable at any point except at the center of the dimple.

$$y(x) = a\left(\sqrt[3]{x^2} - \sqrt[3]{\left(\frac{d}{2}\right)^2}\right)$$

In order to maintain an appropriate level of manufacturability and preserve the integrity of the curve in the dimple profile:

$$0.005 \le a < 0.075.$$

The chord volume, $V_c$, is calculated as follows:

$$V_c = \pi a \frac{\sqrt[3]{\left(\frac{d}{2}\right)^8}}{4}$$

wherein 'a' is the depth factor and 'd' is the dimple diameter.

The chord volume, $V_c$, relates to the dimple diameter, d, such that:

$$.0010 \le \frac{V_c}{d^2} \le .0040,$$

and, in a particular embodiment:

$$.0015 \le \frac{V_c}{d^2} \le .0030.$$

The tangential angle, $\theta_T$, at any point on the curve is calculated as follows:

$$\theta_T = \frac{180}{\pi}\tan^{-1}\left(2/3\frac{a}{\sqrt[3]{x}}\right)$$

wherein 'a' is the depth factor.

The chord angle, $\theta_{CHORD}$, is the tangential angle of the curve at the dimple perimeter, and is calculated as follows:

$$\theta_{CHORD} = \frac{180}{\pi}\tan^{-1}\left(\frac{2}{3}\frac{a}{\sqrt[3]{\frac{d}{2}}}\right)$$

wherein 'a' is the depth factor and 'd' is the dimple diameter.

The cap angle, $\theta_{CAP}$, is calculated as follows:

$$\theta_{CAP} = \frac{90d}{\pi\sqrt{\left(\frac{D_B}{2}\right)^2 - \left(\frac{d}{2}\right)^2}}$$

wherein 'd' is the dimple diameter and $D_B$ is the ball diameter.

The edge angle, EA, is determined by adding the chord angle to the cap angle:

$$EA = \theta_{CHORD} + \theta_{CAP}.$$

In a particular embodiment, the edge angle is within a range having a lower limit of 8 degrees or 10 degrees and an upper limit of 12.5 degrees or 13 degrees.

The rate of change of the slope at any point of the profile is negative, such that:

$$-\frac{2a}{9}\sqrt[3]{\left(\frac{d}{2}\right)^{-4}} < 0$$

wherein 'a' is the depth factor and 'd' is the dimple diameter.

Figure 2:
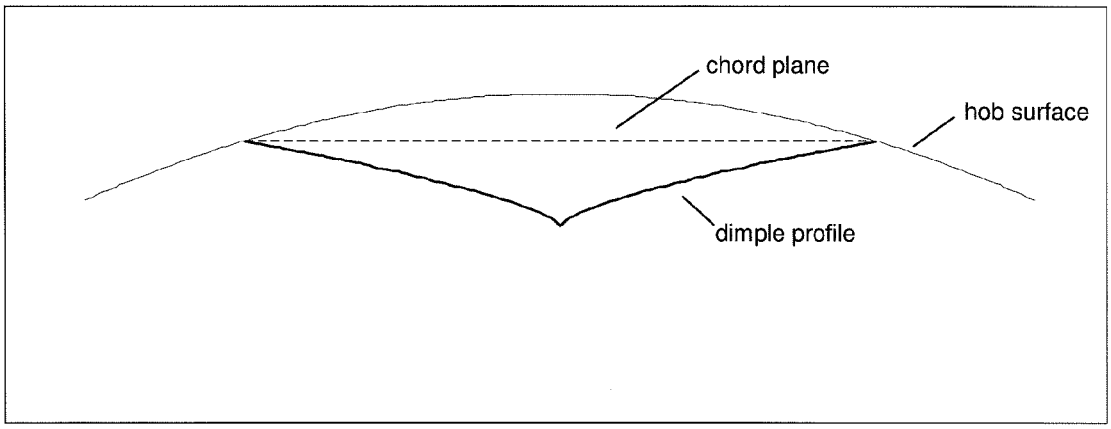
FIG. 2 shows a dimple cross-sectional profile of the present invention.

Referring now to the figures, FIG. 2 shows a dimple cross-sectional profile defined by a curve based on a semi-cubical parabola, the dimple having a dimple diameter of 0.200 inches and a depth factor of 0.051. As discussed above, the mathematical formula representing the curve is as follows:

$$y(x) = a\left(\sqrt[3]{x^2} - \sqrt[3]{\left(\frac{d}{2}\right)^2}\right)$$

wherein 'a' is the depth factor and 'd' is the dimple diameter.

Figure 3:
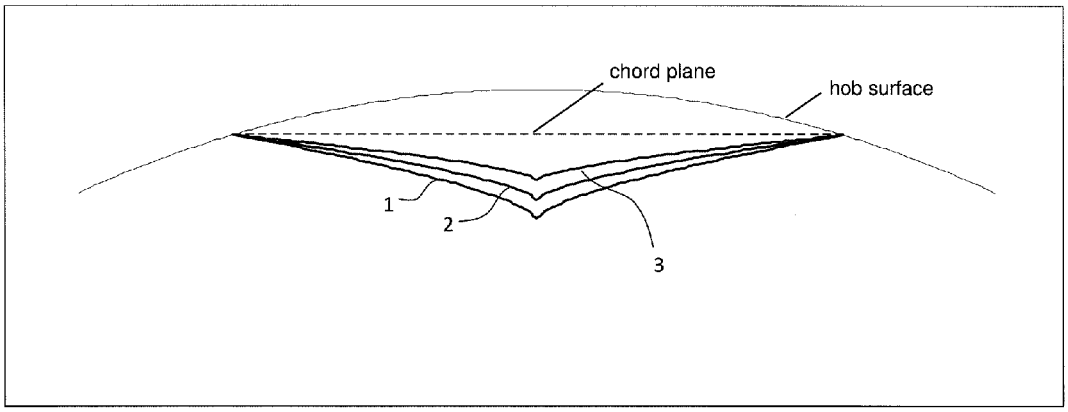
FIG. 3 shows several dimple cross-sectional profiles of the present invention.

Similarly, FIG. 3 shows dimple cross-sectional profiles 1, 2, and 3, according to the present invention, wherein the dimple diameter remains constant at 0.200 inches, but the depth factor is changed. Profiles 1, 2, and 3, have a depth factor of 0.051, 0.039, and 0.027, respectively. As illustrated in FIG. 3, the depth and volume of the dimple can be controlled by changing the depth factor.

The chord volume, chord angle, and edge angle of the profiles shown in FIG. 3 are given in Table 1 below.

TABLE 1

| Profile # | Chord Volume | Chord Angle | Edge Angle |
|---|---|---|---|
| 1 | 0.000086 | 4.2° | 11.1° |
| 2 | 0.000066 | 3.2° | 10.1° |
| 3 | 0.000046 | 2.2° | 9.1° |

The present invention is not limited by any particular dimple pattern. Examples of suitable dimple patterns include, but are not limited to, phyllotaxis-based patterns; polyhedron-based patterns; and patterns based on multiple copies of one or more irregular domain(s) as disclosed in U.S. Pat. No. 8,029,388, the entire disclosure of which is hereby incorporated herein by reference; and particularly dimple patterns suitable for packing dimples on seamless golf balls. Non-limiting examples of suitable dimple patterns are further disclosed in U.S. Pat. Nos. 7,927,234, 7,887,439, 7,503,856, 7,258,632, 7,179,178, 6,969,327, 6,702,696, 6,699,143, 6,533,684, 6,338,684, 5,842,937, 5,562,552, 5,575,477, 5,957,787, 5,249,804, 5,060,953, 4,960,283, and 4,925,193, and U.S. Patent Application Publication Nos. 2006/0025245, 2011/0021292, 2011/0165968, and 2011/0183778, the entire disclosures of which are hereby incorporated herein by reference. Non-limiting examples of seamless golf balls and methods of producing such are further disclosed, for example, in U.S. Pat. Nos. 6,849,007 and 7,422,529, the entire disclosures of which are hereby incorporated herein by reference.

In a particular embodiment, the dimple pattern provides for overall dimple coverage of 60% or greater, or 65% or greater, or 75% or greater, or 80% or greater, or 85% or greater, or 90% or greater.

Golf balls of the present invention typically have a dimple count within a limit having a lower limit of 250 and an upper limit of 350 or 400 or 450 or 500. In a particular embodiment, the dimple count is 252 or 272 or 302 or 312 or 320 or 328 or 332 or 336 or 340 or 352 or 360 or 362 or 364 or 372 or 376 or 384 or 390 or 392 or 432.

Preferably, at least 30%, or at least 50%, or at least 60%, or at least 80%, or at least 90%, or at least 95% of the total number of dimples have a cross-sectional profile defined by a curve that is based on a semi-cubical parabola, with the remaining dimples, if any, having a cross-sectional profile based on any known dimple profile shape including, but not limited to, parabolic curves, ellipses, spherical curves, saucer-shapes, sine curves, truncated cones, flattened trapezoids, and catenary curves. Among the dimples having a cross-sectional profile defined by the present invention, the profile of one dimple may be the same as or different from the profile of another dimple. Similarly, among the remaining dimples, if any, having a known dimple profile shape, the profile of one dimple may be the same as or different from the profile of another dimple.

The diameter of the dimples is preferably within a range having a lower limit of 0.090 inches or 0.100 inches or 0.115 inches or 0.125 inches and an upper limit of 0.185 inches or 0.200 inches or 0.225 inches.

The chord depth of the dimples is preferably within a range having a lower limit of 0.002 inches or 0.004 inches or 0.006 inches and an upper limit of 0.008 inches or 0.010 inches or 0.012 inches or 0.014 inches or 0.016 inches.

The present invention is not limited by any particular golf ball construction or any particular composition for forming the golf ball layers. For example, functionally weighted curves of the present invention can be used to form dimple profiles on one-piece, two-piece (i.e., a core and a cover), multi-layer (i.e., a core of one or more layers and a cover of one or more layers), and wound golf balls, having a variety of core structures, intermediate layers, covers, and coatings.

When numerical lower limits and numerical upper limits are set forth herein, it is contemplated that any combination of these values may be used.

All patents, publications, test procedures, and other references cited herein, including priority documents, are fully incorporated by reference to the extent such disclosure is not inconsistent with this invention and for all jurisdictions in which such incorporation is permitted.

While the illustrative embodiments of the invention have been described with particularity, it will be understood that various other modifications will be apparent to and can be readily made by those of ordinary skill in the art without departing from the spirit and scope of the invention. Accordingly, it is not intended that the scope of the claims appended hereto be limited to the examples and descriptions set forth herein, but rather that the claims be construed as encompassing all of the features of patentable novelty which reside in the present invention, including all features which would be treated as equivalents thereof by those of ordinary skill in the art to which the invention pertains.

What is claimed is:

1. A golf ball having a plurality of recessed dimples on the surface thereof, wherein at least a portion of the recessed dimples have a cross-sectional profile defined by a curve based on a semi-cubical parabola function in the form of:

$$y(x) = a\left(\sqrt[3]{x^2} - \sqrt[3]{\left(\frac{d}{2}\right)^2}\right)$$

wherein a is the depth factor, d is the dimple diameter, and wherein $$\frac{-d}{2} \le x \le \frac{d}{2}.$$

2. The golf ball of claim 1, wherein the depth factor, a, is from 0.005 to 0.075.

3. The golf ball of claim 1, wherein the dimple has a chord volume ($V_c$) defined by the equation:

$$V_c = \pi a \frac{\sqrt[3]{\left(\frac{d}{2}\right)^8}}{4}$$

wherein a is the depth factor, and d is the dimple diameter.

4. The golf ball of claim 3, wherein the chord volume, $V_c$, relates to the dimple diameter, d, such that:

$$.0010 \le \frac{V_c}{d^2} \le .0040.$$

5. The golf ball of claim 3, wherein the chord volume $V_c$, relates to the dimple diameter, d, such that:

$$.0015 \le \frac{V_c}{d^2} \le .0030.$$

6. The golf ball of claim 1, wherein 30% or greater of the plurality of recessed dimples have a cross-sectional profile defined by a curve based on a semi-cubical parabola.

* * * * *